US006679496B2

(12) United States Patent
Grebler et al.

(10) Patent No.: US 6,679,496 B2
(45) **Date of Patent: *Jan. 20, 2004**

(54) ACTIVITY-DIRECTED STACKING PIECE GAME

(75) Inventors: Robert Grebler, Santa Monica, CA (US); Paul Eveloff, San Ansalmo, CA (US); Amanda Birkinshaw, Stockley Park (GB)

(73) Assignee: Pokonobe Associates, Ross, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/189,581

(22) Filed: Jul. 8, 2002

(65) Prior Publication Data

US 2002/0167130 A1 Nov. 14, 2002

Related U.S. Application Data

(63) Continuation of application No. PCT/US01/00505, filed on Jan. 8, 2001.

(60) Provisional application No. 60/174,811, filed on Jan. 7, 2000.

(51) Int. Cl.[7] ..... A63F 3/00

(52) U.S. Cl. ..... 273/290; 273/160; 273/241; 273/293; 273/450

(58) Field of Search ..... 273/290, 450, 273/449, 293, 160, 241

(56) References Cited

U.S. PATENT DOCUMENTS

| | | | | | |
|---|---|---|---|---|---|
| 3,827,160 | A | * | 8/1974 | Talbot et al. | 434/208 |
| 3,863,918 | A | * | 2/1975 | Kramer | 273/450 |
| 4,215,858 | A | * | 8/1980 | Olsen | 273/447 |
| 4,293,128 | A | * | 10/1981 | Ebel | 273/450 |
| 4,303,240 | A | * | 12/1981 | Ellman et al. | 273/450 |
| 4,522,393 | A | * | 6/1985 | Dunn | 273/447 |
| 4,635,939 | A | * | 1/1987 | Makow | 273/296 |
| 5,375,846 | A | * | 12/1994 | Smith | 273/292 |
| 5,967,517 | A | * | 10/1999 | Villano | 273/292 |
| 6,022,026 | A | * | 2/2000 | Johnson, III | 273/450 |
| 6,161,832 | A | * | 12/2000 | Holahan et al. | 273/241 |

FOREIGN PATENT DOCUMENTS

| | | | | |
|---|---|---|---|---|
| DK | 247 515 A1 | * | 12/1987 | A63F/9/00 |
| EP | 0190876 | | 8/1986 | A63F/9/00 |
| EP | 0247515 | | 12/1987 | A63F/9/00 |
| GB | 523107 | * | 5/1949 | A63F/9/00 |
| GB | 623107 | | 5/1949 | |
| GB | 2130105 | | 5/1984 | A63F/9/00 |
| GB | 2 130 105 A | * | 5/1984 | A63F/9/00 |
| GB | 0 190 876 A2 | * | 8/1986 | A63F/9/00 |
| WO | PCT/CA97/00045 | | 1/1997 | |
| WO | WO 97/26961 | * | 7/1997 | |

OTHER PUBLICATIONS

PCT WO 97/26961—Irwin Toys Limited Jul. 1997.*

* cited by examiner

*Primary Examiner*—Benjamin H. Layno
*Assistant Examiner*—Dolores R. Collins
(74) *Attorney, Agent, or Firm*—Katten Muchin Zavis Rosenman

(57) ABSTRACT

A stacking piece game includes a plurality of game pieces stackable in layers, with each game piece being associated with one of a plurality of task classes and one of a plurality of activities associated with the one task class. At least one of the game pieces includes a task class indicia identifying the one task class and an activity description of the one activity. The game is played by (1) stacking the game pieces in layers to form a tower; (2) removing one of the game pieces from the tower; (3) performing an activity determined in accordance with at least the indicia of the removed game piece; (4) returning the removed game piece to the tower upon completion of the activity; and (5) repeating the removing, and returning steps amongst players of the game until the tower collapses.

31 Claims, 1 Drawing Sheet

ACTIVITY-DIRECTED STACKING PIECE GAME

This application is a continuation of PCT/US01/00505, filed Jan. 8, 2001, incorporated herein by reference.

FIELD OF THE INVENTION

The present invention relates to a game which is played using a set of stackable game pieces. In particular, the present invention relates to a game which employs a set of stackable game pieces which direct players to perform an activity upon manipulation of the game pieces.

BACKGROUND OF THE INVENTION

Games using stackable game pieces are well known. For instance, in U.S. Pat. No. 3,863,918, Kramer teaches a game in which players are provided with a set of game pieces of various shapes, and are required to stack the game pieces on top of each other in layers without causing the structure to collapse. Although such games may be suitable for young children, their simplicity would not maintain the interest of older children or adults.

Other games using stackable game pieces have been developed having a greater level of difficulty than the traditional stacking piece game. In one such game, marketed under the trade-mark JENGA, a tower is constructed from a set of game blocks of generally elongate parallelepiped shape, with the blocks in each layer being perpendicular to the blocks in the layer above and the layer below. Players are required to remove a block from the tower and place it on the uppermost layer without toppling the tower. The ability to strategically select game blocks from the tower increases the level of difficulty of the game.

More recently, a game marketed under the trade-mark JENGA ULTIMATE was developed having an even greater level of difficulty than JENGA. The game is played in a manner similar to JENGA, but employs of set of elongate coloured parallelepiped game blocks. A player rolls a die having coloured faces matching the colours on the game blocks, with the colour of the uppermost die face determining the colour of the game block which can be removed from the tower. By so limiting the number of blocks which can be removed, the level of difficulty of the game is increased.

Although JENGA and JENGA ULTIMATE have been commercially successful, it is desirable to provide a stacking game using stackable game pieces which produces an even greater level of difficulty.

SUMMARY OF THE INVENTION

According to the invention, there is provided a stacking block game, a stacking block game kit and a method of playing a stacking block game which addresses deficiencies of the prior art.

The stacking block game, according to the invention, comprises a collapsible tower constructed from a plurality of layers of stacked building pieces. Each building piece is associated with one of a plurality of task classes and one of a plurality of activities associated with the one task class. At least one of the building pieces includes a task class indicia identifying the one task class and an activity description of the one activity.

The stacking block kit, according to the invention, includes a set of game cards, and a plurality of game pieces. Each game card is associated with one of a plurality of task classes and one of a plurality of activities associated with the one task class. Further, each game card includes an activity description identifying the one activity. The game pieces are stackable in layers, with each game piece being associated with a respective one of the task classes and a respective one of the activities.

In accordance with one aspect of the invention, the stacking piece game is played by (1) providing an assembly of game pieces; (2) removing one of the game pieces from the assembly; (3) performing an activity associated with the removed game piece; (4) returning the removed game piece to the assembly upon completion of the activity; and (5) repeating the removing, performing and returning steps amongst players of the game until a predetermined solution is reached.

In accordance with another aspect of the invention, the stacking piece game is played by (1) providing a tower of stackable game pieces for players of the game; and (2) rearranging the game pieces within the tower. According to this latter aspect, the arranging step comprising (a) each player removing one of the game pieces from the assembly, (b) performing an activity associated with the removed game piece, and (c) returning the removed game piece to the tower upon completion of the activity.

In a preferred embodiment of the invention, each game piece comprises a stackable game piece which is marked with an indicia which identifies a task class to which the game piece belongs. Further, preferably a portion of the game pieces are marked with a description of a task consistent with the task class of the game piece. However, in an alternate embodiment, the task description is provided on a set of playing cards.

Preferably, the game pieces are divided into three task classes, with one of the task classes comprising a truth task class in which the tasks of all the game pieces associated with the class identify a truth statement which a player must provide, and another of the task classes comprising a risk task class in which all the game pieces associated with the class identify a risk or a dare which a player must undertake, and the remaining task class comprising a user-defined task class in which a portion of the game pieces associated with the class identify a user-defined task.

Preferably, each game piece is a parallelopiped-shaped game piece whose width is one-third its length. Initially, the game pieces are stacked in layers to form a tower, with each layer comprising three game pieces and the game pieces in each layer being oriented at a right angle relative to the game pieces in the layers immediately adjacent. Then, one of the players selects one of the task classes, and removes from the tower a game piece having the indicia associated with selected task class. The player then reads the description of the task associated with the game piece removed. If the removed game piece is associated with the truth task class, the player must provide the identified truthful statement. If the removed game piece is associated with the risk task class, the player must undertake the identified risk. If the removed game piece is associated with the user-defined task class and has an associated task, the player must perform the identified task.

Once the identified task is completed to the satisfaction of the other players, the player returns the removed game piece to the uppermost layer of the tower. However, in an alternate embodiment, each player is provided with a "pass" card which entitles the player to return the removed game piece to the uppermost layer of the tower without performance of the identified task.

If the player chooses not to complete the identified task, the player returns the removed game piece to the uppermost layer of the tower without performance of the identified task, selects and removes another game piece from the tower, and then returns this latter game piece to the uppermost layer of the tower upon performance of the task identified with the latter game piece. Also, if the removed game piece is associated with the user-defined task class but has no associated task, the player may return the removed game piece to the uppermost layer of the tower without performance of a task.

Each player takes turns removing a game piece, and returning the removed game piece until the tower collapses.

BRIEF DESCRIPTION OF THE DRAWINGS

The present invention will now be described, by way of example only, with reference to the drawings, in which.

DETAILED DESCRIPTION OF THE PREFERRED EMBODIMENT

Figure 1:
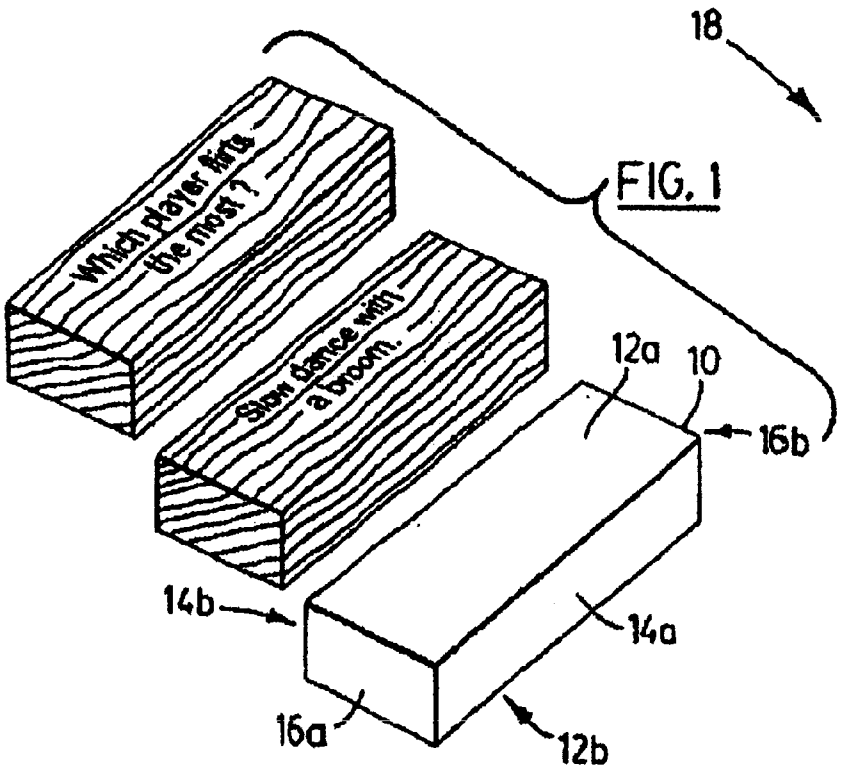
FIG. 1 is a perspective view of three stacking game pieces used in the stacking piece game according to the invention.

Turning to FIG. 1, a game piece for the stacking piece game, according to the invention, and denoted with reference numeral 10, is shown comprising a substantially parallelopiped-shaped stacking block including a pair of opposed planar faces 12*a,* 12*b,* a pair of opposed planar sides 14*a,* 14*b,* and a pair of opposed planar ends 16*a,* 16*b.* However, it should be understood that the invention is not limited to parallelopiped-shaped game pieces, but may instead include interlocking blocks or any other game piece capable of being arranged to form a collapsible structure. Further, the game piece 10 may comprise a virtual game piece, implemented through computer software which simulates collapse of a structure comprising the virtual game pieces.

Preferably, each game piece 10 is marked with a description of a task which a player of the game is required to perform as part of the game, with the task description being marked on a face 12 of the game piece 10. However, some or all of the task descriptions may instead be marked on a side 14 of the respective game pieces 10, if desired.

Each game piece 10 is classified into a task class associated with the task described on the game piece 10, and includes a task class indicia uniquely identifying the task class of the game piece 10. The task class indicia may comprise a unique colour associated with each task class, or may comprise a symbol, combination of symbols or other suitable indicia. Preferably, the task class indicia is provided over the entire outer surface (comprising the faces 12, the sides 14, and the ends 16) of each game piece 10, or is provided at least on one of the ends 16 of each game piece 10. As will become apparent from the following discussion, this latter position ensures that the task class indicia of each game piece 10 is viewable by the game players.

The game pieces 10 may be associated with one of any number of task classes. However, preferably the game pieces 10 are associated with one of three task classes: a truth task class, a risk task class, or a user-defined task class, with an equal number of game pieces 10 being associated with each task class.

The truth task class comprises tasks which require a player to answer a question truthfully. Suitable task descriptions of the truth task class include, but are not limited to, the following questions:

1. What's the best game you've played in the dark?
2. Which player flirts the most?
3. What's the most fun time you've had in a car?
4. Ever been skinny-dipping? Details, please!
5. What's your favorite battery-operated toy?
6. Which player has the worst haircut?
7. What's the worst thing your parents ever saw you do?
8. What was your most embarrassing moment ever?
9. If you could have anything, what would it be?
10. Describe your worst moment at a party?
11. Which player would you like to be stranded on a desert island with?
12. Tell us about your first kiss?
13. Have you ever gone out without your underwear? Details, please!
14. What's your greatest fear?
15. What's the most daring thing you've ever done?
16. Who's a dream date for the person on your right? Why?
17. What's the most embarrassing thing you've had to buy?
18. Which famous personality do you have a crush on? Why?

The risk task class comprises tasks which require a player to undertake a risk. Suitable task descriptions of the risk task class include, but are not limited to, the following risk undertakings:

1. Blow in someone's ear.
2. Stand up and sing a song.
3. Slow dance with a broom.
4. Remove an item of clothing.
5. Tickle someone—your choice.
6. Imitate a pop or rock star.
7. Kiss the person on your left.
8. Do an impression of a belly dancer.
9. Mime three things you do before you go to sleep.
10. Say something romantic to the person next to you.
11. Blow a raspberry on someone's tummy.
12. Pick another block.
13. Sit on the lap of the person on your right, until your next turn.
14. Impersonate someone in the room.
15. Spin around ten times fast.
16. Rub noses with another player.
17. Pretend you're riding.
18. Swap an item of clothing with someone else.

The user-defined task class comprises tasks which are defined by the players. The user-defined class may comprise questions or undertakings which would otherwise suitably belong to the truth task class or the risk task class, or may comprise questions or undertakings which would not belong to either the truth task class or the risk task class. Preferably, the task descriptions of the game pieces 10 comprising the user-defined task class are inscribed in pencil or non-permanent ink onto the game pieces 10.

Preferably, the width of each game piece 10 is 1/"N" of the length of the game piece 10, and the game pieces 10 are arranged substantially parallel to one another in layers each having a maximum number "N" of game pieces 10 to form a tower 18 of stacked game pieces 10. However, the game pieces 10 need not be arranged to form a tower 18. Rather, if the game pieces 10 comprise interlocking game pieces, for instance, the game pieces 10 may be arranged to form an alternate structure, such as a bridge.

Figure 2:
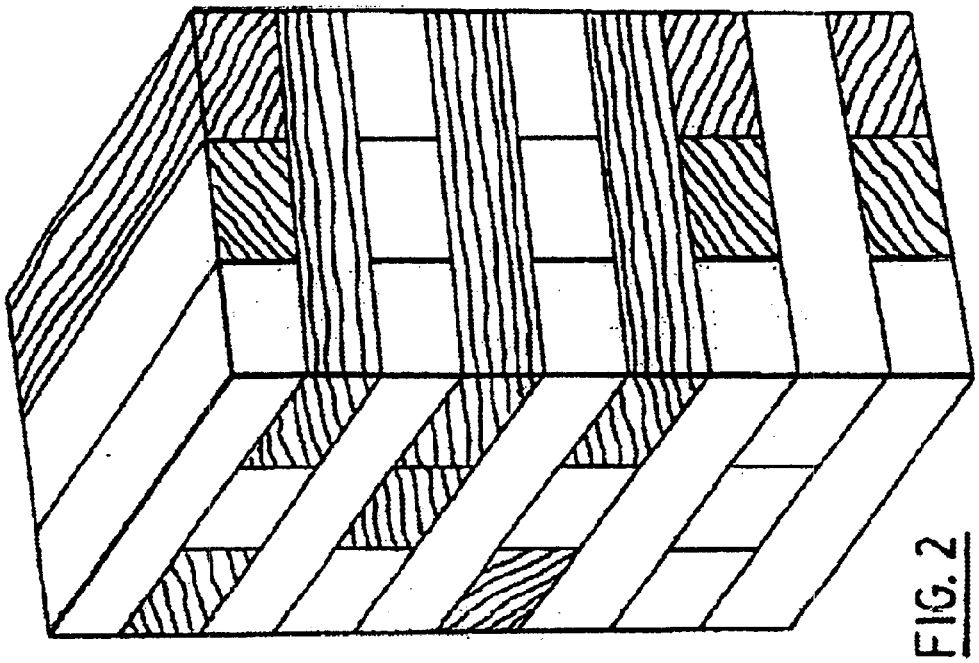
FIG. 2 is a perspective view of one embodiment of a tower comprising layers of the stacking game pieces shown in FIG. 1.

As shown in FIG. 2, preferably the width of each game piece 10 is ⅓ the length, and the game pieces 10 are arranged in the tower 18 in layers of three game pieces 10 per layer. Further, preferably each layer of the tower 18 comprises one game piece 10 from each of the task classes. However, it will be appreciated that the invention is not so limited. Rather, in one variation, the game pieces 10 are randomly distributed throughout the layers of the tower 18, and in another variation all the game pieces 10 in each layer of the tower 18 are members of a common task class.

Preferably, the game pieces 10 are oriented such that the task class indicia of each game piece 10 is visible to each game player. Further, preferably the game pieces 10 in each layer are oriented at a right angle relative to the game pieces 10 in the layers immediately adjacent, and are laid on their faces 12 (with the task description being marked on the face 12) so that the task description marked on the game pieces 10 is not apparent from the assembled tower 18. However, some or all of the game pieces 10 may be laid on their sides 14, provided that the task description of each game piece 10 so oriented is not apparent from the assembled tower 18.

Once the game pieces 10 are arranged into the desired arrangement, as described above, one of the players is elected to start the game. The starting player may be elected on the basis of the relative ages of the players, on the basis of a roll of a die, or some other basis known to those skilled in the art. The starting player then selects a desired task class and, using one hand only, removes from the tower 18 one of the game pieces 10 having indicia associated with the desired task class. Preferably, the game piece 10 removed from a layer of game pieces 10 located below the uppermost layer of the tower 18.

The starting player then performs the task described on the removed game piece 10. Once the task is performed to the satisfaction of the other players, the player returns the game piece 10 to the uppermost layer of the tower 18, using one hand only. Preferably, the player positions the game piece 10 parallel to the other game pieces 10 in the uppermost layer, and ensures that the task class indicia of the game piece 10 is visible to each game player. Further, preferably the player positions the removed game piece 10 in the uppermost layer at a right angle to the game pieces 10 in the layer immediately below the uppermost layer.

If the uppermost layer already includes the maximum number "N" of game pieces 10, the player positions the game piece 10 on the existing uppermost layer, thereby creating a new uppermost layer. Alternately, the player may commence a new uppermost layer prior to the uppermost layer including the maximum number of "N" of game pieces 10.

The game continues with each game player in turn removing a game piece from the tower 18 and returning the game piece 10 to the uppermost layer of the tower 18. If while removing or returning a game piece 10, the tower 18 collapses, the game ends and the last player who returned a game piece 10 to the tower 18 is deemed to be the winner.

Thus far, the invention has been described as requiring each player to perform the task identified on the removed game piece 10. However, this stipulation is not an essential feature of the invention. In one variation, the player may elect to return the game piece 10 to the uppermost layer of the tower 18 without performing the required task. According to this variation, if the player returns the game piece 10 to the tower 18 without performing the required task, the player must then select and remove another game piece 10 from the tower 18, as described above, and then return this latter game piece 10 to the uppermost layer of the tower 10 upon performance of the task identified with the latter game piece 10. Alternately, in another variation, each player is provided with one or more "pass" cards which a player may utilize to return a removed game piece 10 to the uppermost layer of the tower 18 without performing the required task.

Thus far, the invention has been described as requiring each game piece 10 to include a task description. However, this stipulation is also not an essential feature of the invention. Rather, a portion of the game pieces 10 may exclude a task description to provide an element of variability to the invention. Consequently, in yet another variation, a description of a truth task is provided on each game piece 10 comprising the truth task class, and a description of a risk task is provided on each game piece 10 comprising the risk task class, but a task description is excluded from a portion of the game pieces 10 comprising the user-defined class. According to this variation, if a player removes a game piece 10 from the tower 18 and the removed game piece 10 does not include a description of a task, the player may return the game piece 10 to the uppermost layer of the tower 18 without performing any required task.

In another variation of the invention, none of game pieces 10 are marked with a task description. Rather, the task descriptions are provided on the faces of playing cards, with each playing card back including indicia corresponding to the task class of the described task, and each game piece 10 including task class indicia corresponding to one of the task classes. Preferably, the playing cards are grouped into piles according to their respective task class, with the cards facing down to prevent the players from viewing the description on a card until removed from its pile. According to this variation, the player selects a desired task class and, using one hand only, removes from the tower 18 one of the game pieces 10 having indicia associated with the desired task class. The player then removes a playing card from the card pile associated with the selected task class, and performs the task described on the removed playing card. As above, once the task is performed to the satisfaction of the other players, the player places the removed game piece 10 on the uppermost layer of the tower 18.

Further, the invention has also been described as requiring each game piece 10 to include task class indicia oriented such that the task class indicia of game pieces 10 is visible by each game player. However, this stipulation is also not an essential feature of the invention, but may be eliminated from the game pieces 10 altogether. Consequently, in yet another variation of the invention, some or none of the task class indicia are visible by the game players. According to this variation, the player selects one of the game pieces 10 from the tower 10, and then removes a playing card from the card pile associated with the selected task class, and performs the task described on the removed playing card.

Alternately, the task class indicia may be eliminated from the game pieces 10 and the playing cards, with the playing cards being distributed randomly into a single pile. The player selects one of the game pieces 10 from the tower 10, and removes a playing card from the pile, and then performs the task identified on the removed playing card. This latter variation is advantageous where all the tasks are classified into a single task class, such as trivia questions. According to this variation, the player collects points for each correct answer. The player is allowed to continue to answer questions until the first incorrect answer, at which time the player must return the game piece 10 to the tower. The player with the highest total when the tower collapses is deemed to be the winner of the game.

The present invention is defined by the claims appended hereto, with the foregoing description being illustrative of the preferred embodiment of the invention. Those of ordinary skill may envisage certain additions, deletions and/or modifications to the preferred embodiment which, although not explicitly identified or suggested herein, do not depart from the spirit or scope of the invention, as defined by the appended claims.

We claim:

1. A collapsible tower comprising a plurality of layers of stacked building pieces, at least one of the building pieces including a task class indicia identifying one of a plurality of task classes, and an activity description associated with the one task class, the task classes including one of a truth task class and a dare task class, the activity description associated with the truth task class identifying a statement to be truthfully given, the activity description associated with the dare task class identifying a dare to be performed.

2. The tower according to claim 1, wherein the building pieces have a pair of opposite ends, and at least one face extending between the opposite ends, the activity description being provided on the at least one face, and at least one of the building pieces is disposed within each said layer such that the respective activity description is concealed from view.

3. The tower according to claim 2, wherein the task class indicia is provided on the opposite ends.

4. The tower according to claim 1, wherein the building pieces in each said layer arc oriented at a right angle relative to the building pieces in an adjacent one of the layers, and are disposed substantially parallel to each other.

5. The tower according to claim 1, wherein each said layer includes a predetermined maximum number of the building pieces, and each said building piece has a length and a width, said width being a portion of said length, said portion being a reciprocal of said maximum number.

6. A stacking block kit, comprising:

a set of game cards, each said game card being associated with one of a plurality of task classes, and including an activity description defining an activity associated with the one task class, the task classes including one of a truth task class and a dare task class, the activity associated with the truth task class identifying a statement to be truthfully given, the activity associated with the dare task class identifying a dare to be performed;

a plurality of game pieces stackable in layers, each said game piece including a task class indicia associated with a respective one of the task classes; and a set of game rules defining movement of the game pieces between the layers, the game rules requiring players to perform the steps of (1) constructing a tower of the game pieces, (2) removing one of the game pieces from other than an uppermost layer of the tower, (3) performing the activity associated with the removed one game piece; (4) returning the removed one game piece to the uppermost layer of the tower upon completion of the activity; and (5) repeating the removing, performing and returning steps amongst the players until a predetermined solution is reached.

7. The kit according to claim 6, wherein the game pieces have a pair of opposite ends, and the task class indicia is provided on at least one of the opposite ends.

8. The kit according to claim 7, wherein each said game card includes the task class indicia.

9. A method of playing a game comprising the steps of:

arranging a plurality of game pieces into layers, each said game piece being associated with one of a plurality of task classes and an activity associated with the one task class, the task classes including one of a truth task class and a dare task class, the activity associated with the truth task class identifying a statement to be truthfully given, the activity associated with the dare task class identifying a dare to be performed;

removing one of the game pieces from other than an uppermost one of the layers;

performing the activity associated with the removed one game piece; returning the removed one game piece to the uppermost layer upon completion of the activity; and repeating the removing, performing and returning steps amongst players of the game until a predetermined solution is reached.

10. The method according to claim 9, wherein the one game piece is associated with the truth task class, the removing step comprises one of the players extracting the one game piece from the assembly, and the performing step comprises the one player providing the truthful statement associated with the one game piece.

11. The method according to claim 9, wherein the one game piece is associated with the dare task class, the removing step comprises one of the players extracting the one game piece from the assembly, and the performing step comprises the one player undertaking the risk associated with the one game piece.

12. The method according to claim 9, wherein the one game piece is associated with a user-defined task class, the activity associated with the user-identified task class identifying a user-defined act, the removing step comprises one of the players extracting the one game piece from the assembly, and the performing step comprises the one player performing the act associated with the one game piece.

13. The method according to claim 9, wherein the activity is identified on the one game piece.

14. The method according to claim 9, wherein the one game piece includes task class indicia identifying the associated task class.

15. The method according to claim 9, wherein the activity is identified on a card associated bearing task class indicia associated with associated task class.

16. The method according to claim 9, wherein the game pieces comprise stackable game pieces, and the providing step comprises forming a tower of the stackable game pieces.

17. The method according to claim 16, wherein the forming step comprises positioning the game pieces in layers, the game pieces in each said layer being oriented at a right angle to the game pieces in an adjacent one of the layers.

18. The method according to claim 17, wherein each said layer comprises a predetermined number of the game pieces, and each said game piece has a parallelopiped shape, a width, and a length, the width being a portion of the length, the portion being a reciprocal of the predetermined number.

19. The method according to claim 9, wherein the game pieces comprise stackable game pieces, and the returning step comprises maintaining a tower of the stackable game pieces.

20. The method according to claim 19, wherein the maintaining step comprises positioning the removed game pieces in layers, the game pieces in each said layer being oriented at a right angle to the game pieces in an adjacent one of the layers.

21. The method according to claim 20, wherein each said layer comprises a predetermined number of the game pieces, and each said game piece has a parallelopiped shape, a width, and a length, the width being a portion of the length, the portion being a reciprocal of the predetermined number.

22. The method according to claim 9, wherein the predetermined solution is reached when one of the removing and returning steps causes the tower to collapse.

23. A method of playing a game comprising the steps of:

providing a tower of stackable game pieces for players of the game, each said game piece being associated with one of an activity identifying a statement to be truthfully given and an activity identifying a dare to be performed; and rearranging the game pieces within the tower, the arranging step comprising each said player removing one of the game pieces from other than an uppermost layer of the tower, performing the activity associated with the removed one game piece, and returning the removed one game piece to the uppermost layer of the tower upon completion of the activity.

24. The method according to claim 23, wherein the activity identifies the truthful statement to be given, and the performing step comprises the player providing the truthful statement associated with the removed game piece.

25. The method according to claim 23, wherein the activity identifies the dare to be performed, and the performing step comprises the player undertaking the dare associated with the removed game piece.

26. The method according to claim 23, wherein the activity identifies a user-defined act, and the performing step comprises the player performing the act associated with the removed game piece.

27. The method according to claim 23, wherein the activity is identified on the removed game piece.

28. The method according to claim 23, wherein the activity is identified on a card associated with a task class of the activity of the removed game piece.

29. The method according to claim 23, wherein the game pieces comprise stackable game pieces, and the returning step comprises positioning removed ones of the game pieces in layers in the tower, the game pieces in each said layer being oriented at a right angle to the game pieces in an adjacent one of the layers.

30. The method according to claim 23, wherein the rearranging step continues until the tower collapses.

31. A stacking block kit, comprising:

a plurality of game pieces stackable in layers, each said game piece being associated with one of a plurality of task classes, and an activity description associated with the one task class, the task classes including one of a truth task class and a dare task class the activity description associated with the truth task class identifying a statement to be truthfully given, the activity description associated with the dare task class identifying a dare to be performed; and a set of game rules defining movement of the game pieces between the layers, the game rules requiring players to perform the steps of (1) constructing a tower of the game pieces, (2) removing one of the game pieces from other than an uppermost layer of the tower, (3) performing the activity associated with the removed one game piece; (4) returning the removed one game piece to the uppermost layer of the tower upon completion of the activity; and (5) repeating the removing, performing and returning steps amongst the players until a predetermined solution is reached.

* * * * *